US006645127B1

(12) United States Patent
Pestes

(10) Patent No.: US 6,645,127 B1
(45) Date of Patent: Nov. 11, 2003

(54) WHEELCHAIR EXERCISE APPARATUS

(76) Inventor: Larry L. Pestes, 16007 SE. Amisigger Rd., Boring, OR (US) 97009

( * ) Notice: Subject to any disclaimer, the term of this patent is extended or adjusted under 35 U.S.C. 154(b) by 0 days.

(21) Appl. No.: 10/132,892

(22) Filed: Apr. 24, 2002

(51) Int. Cl.[7] ..... A63B 69/16
(52) U.S. Cl. ..... 482/60; 482/51; 482/904
(58) Field of Search ..... 48/51, 110, 133, 48/134, 148, 142, 904, 908, 54; 601/23, 24, 26; 280/304.1, 304.2; 23/117; 434/61; 180/66; 5/109; 414/921

(56) References Cited

U.S. PATENT DOCUMENTS 5,277,685 A * 1/1994 Gonzales ..... 482/134
6,113,519 A * 9/2000 Goto ..... 482/54

* cited by examiner

*Primary Examiner*—Nicholas D. Lucchesi
*Assistant Examiner*—Tam Nguyen

(74) *Attorney, Agent, or Firm*—Chernoff, Vilhauer, McClung & Stenzel

(57) ABSTRACT

An exercise apparatus for a wheelchair has a raised platform with an upper surface which will support a wheelchair. Front and rear rollers mounted rotatably on the platform project slightly above the platform upper surface to support the driving wheels of the wheelchair. One of the rollers is connected to a flywheel which provides momentum to even out the movement of the rollers and the driving wheels between strokes of the person driving the wheelchair. One or more attachment arms hold the wheelchair immovably on the platform when the user is exercising. The arm is split into two arm sections which rotate relative to one another through a third joint. The outer end of one of the arm sections is pivotally attached to the platform through a first joint and the outer end of the other arm section is pivotally attached to a clamp through a second joint. The clamp is configured to quickly and easily attach to the wheelchair frame. A clamp mechanism causes the first, second and third joints to be simultaneously locked immovably upon the activation of a single handle.

6 Claims, 2 Drawing Sheets

WHEELCHAIR EXERCISE APPARATUS

BACKGROUND OF SUMMARY OF THE INVENTION

This invention relates to an apparatus which allows the user of a wheelchair to exercise, and in particular to such an apparatus in which the wheelchair is easily secured to the apparatus and in which the wheelchair operates in a manner which is similar to actual wheelchair operation.

Most aerobic exercise apparatus, such as treadmills, stationary bicycles, stair step machines and the like do not accommodate people who do not have full use of their legs. While there are exercise apparatus which allow a wheelchair to be driven while held stationary, the prior art apparatus of this type have two shortcomings. First, when a wheelchair is driven in the apparatus it needs to be securely attached to the apparatus if the user is going to exercise vigorously. Many of the prior art wheelchair exercise devices do not allow the wheel chair to be securely attached to them. Furthermore, in those that do, the attachment mechanism is difficult and time consuming to use, particularly for someone in a wheelchair.

Second, when a wheelchair is driven its weight creates momentum which keeps it traveling at relevantly the same speed even though there are intervals where the driving wheels are not being rotated by the user due to the cycling manner in which a user's arms push the driving wheel. The prior art wheelchair exercise apparatus do not do a good job of simulating this momentum.

The subject invention overcomes the foregoing shortcomings and limitations of the prior art wheelchair exercise apparatus by providing an attachment arm having a first arm section with a first joint on its outer end which is pivotally attached to the exercise apparatus and a second arm section with a second joint at its outer end which is pivotally attached to a clamp which can easily and quickly be attached to a frame element of the wheelchair. The inner ends of the first and second arm sections are rotatably connected together through the third joint. A clamp mechanism permits simultaneously fixing the first, second and third joints irrotatably by the activation of a single activation member.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
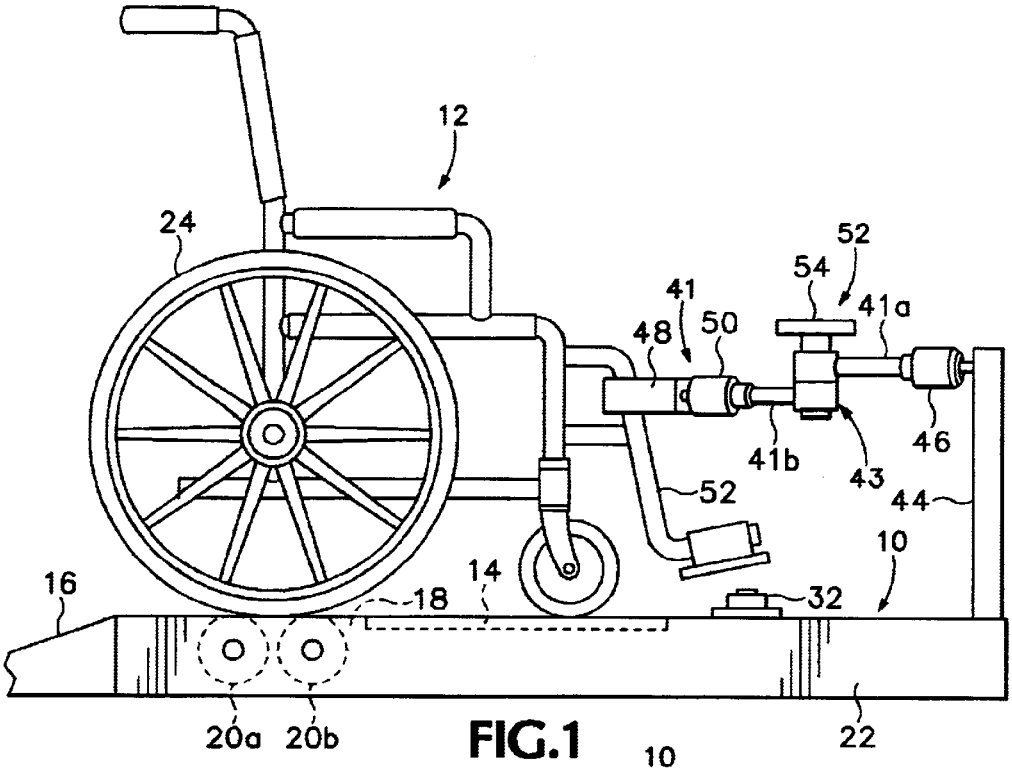
FIG. 1 is a side elevation view of a wheelchair exercise apparatus embodying the subject invention, with a wheelchair in place.
Figure 2:
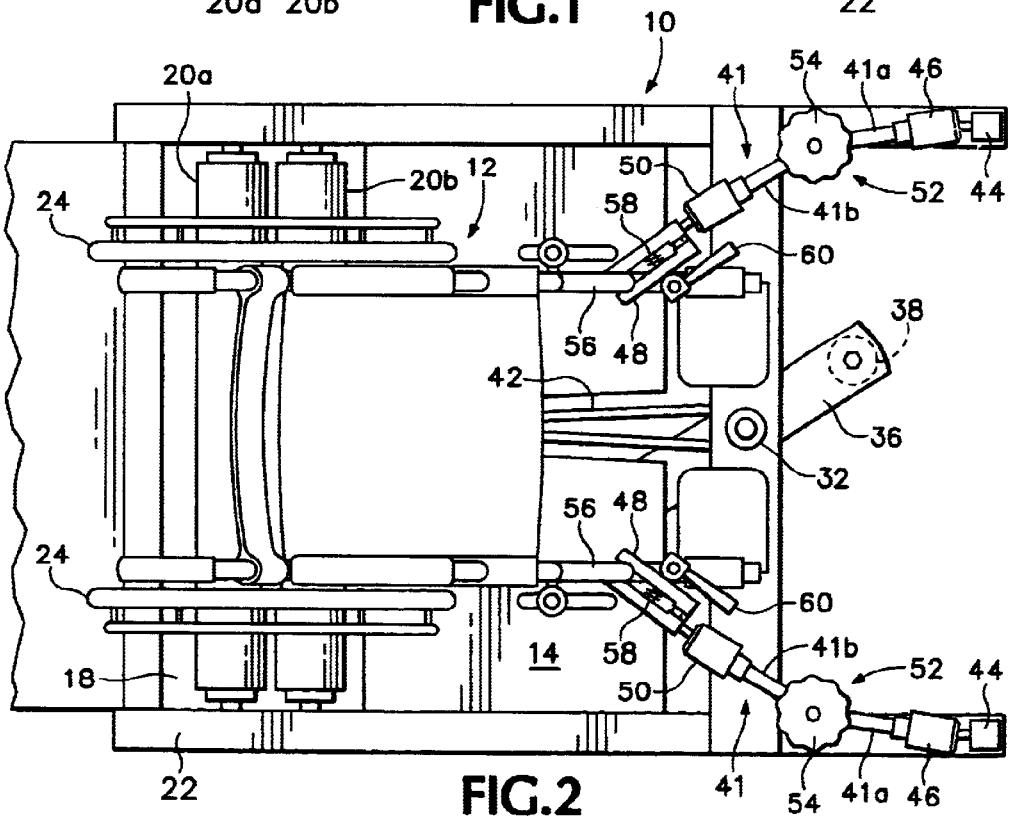
FIG. 2 is a plan view of the exercise apparatus of FIG. 1.

Referring to FIGS. 1 and 2 of the drawings, a platform 10 is configured to support a wheelchair 12 carrying a rider (not shown). The platform 10 has a horizontal planar upper surface 14 and a sloped ramp 16 which allows the wheelchair to be driven up onto the upper surface. A cutout 18 located at the back of the upper surface 14 of the platform exposes a pair of spaced-apart, side-by-side rollers 20*a, b*. The rollers extend transversely across the platform and are rotatably mounted on the sides 22 of the platform. The rollers project through the cutout 18 and extend slightly above the platform upper surface 14. The rollers are arranged to receive the driving wheels 24 of the wheelchair and permit the driving wheels to be rotated when the wheelchair is on the platform. The front roller 20*b* is split into two opposed segments and a pulley 26 is located between the segments on the shaft 28 that carries the front roller.

Figure 3:
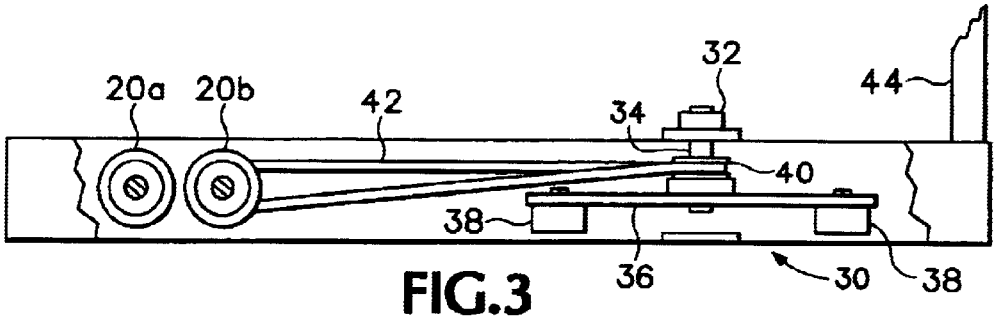
FIG. 3 is a fragmentary side elevational view of the wheelchair exercise apparatus of FIG. 1, without the wheelchair in place, partially broken away to show hidden detail.
Figure 4:
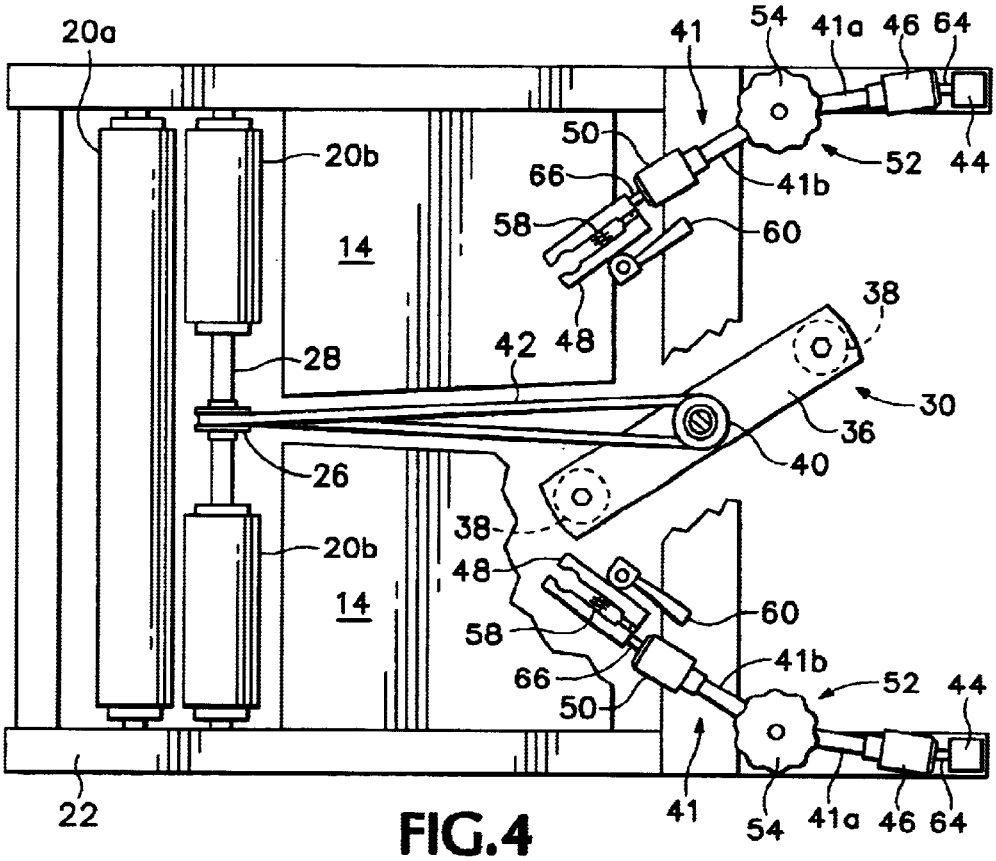
FIG. 4 is a plan view of the wheelchair exercise apparatus of FIG. 1, without the wheelchair in place, partially broken away to show hidden detail.

Referring now also to FIGS. 3 and 4, a flywheel device 30 is rotatably mounted on the front end of the platform in a bearing 32. A shaft 34, which is journaled in and supported by the bearing 32, carries a blade 36 having weights 38 located at each of its ends. A pulley 40, located on the shaft 34, is connected to the pulley 26 by an endless belt 42. Thus, when the driving wheels 24 of the wheelchair and the rollers 20*a* and *b* are rotated, the flywheel is rotated also. As a result, the flywheel imparts momentum to the rollers so that the driving wheel continues to rotate between strokes, much as would occur by wheelchairs driven on the ground.

The wheelchair is held in place on the platform by a pair of attachment arms 41. Each attachment arm is split into a first arm section 41*a*and a second arm section 41*b* which are rotatably attached at their adjacent inner ends through a third joint 43. The outer end of the first arm section 41*a* is pivotally attached through a first joint 46 to a post 44 which projects upwardly from the platform, and the outer end of the second arm section 41*b* is pivotally attached through a second joint 50 to a clamp 48. A clamp mechanism 52 permits the first, second, and third joints to be simultaneously locked and released by turning one handle 54. The clamp 48 is designed to fit over any tubular frame element in the wheelchair, such as the foot support arm 56 shown in the drawings. The clamp is normally urged to its open position by means of a spring 58 and can be closed simply by rotating an over center lever 60.

Figure 5:
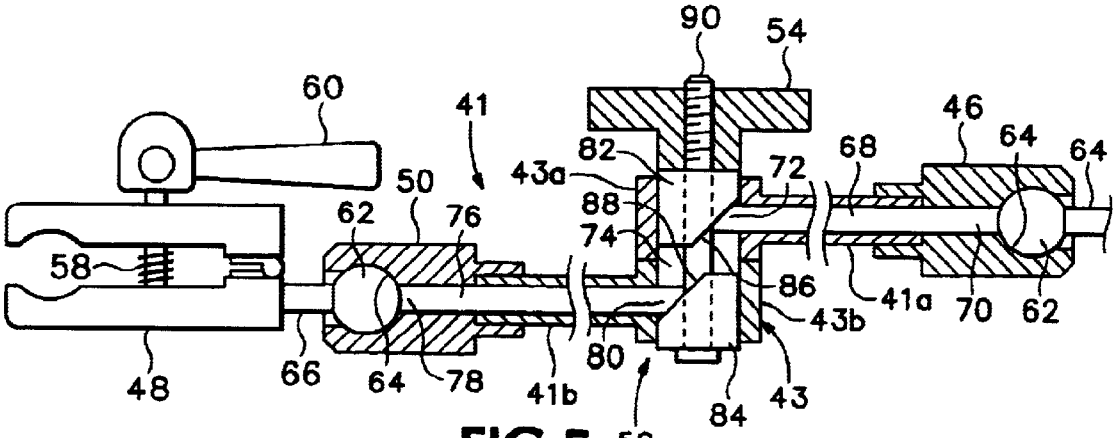
FIG. 5 is a side elevational view, partially broken away to show hidden detail, of a clamp mechanism which is an element of the subject invention.

Referring now also to FIG. 5, balls 62 are located in sockets 64 located in the first and second joints 46, 50. The ball 62 in the first joint 46 is attached to the post 44 through a first stud 64, and the ball 62 in the second joint 50 is attached to the clamp 48 through a second stud 66. A first rod 68 is slidably located in the first arm section 41*a*. An outer end 70 of the first rod 68 abuts the ball 62 in the first joint 46, and the inner end 72 extends into the third joint 43. A second rod 76 is slidably located in the second arm section 41*b*. An outer end 78 of the second rod abuts the ball 62 in the second joint 50, and the inner end 80 extends into the third joint 43. The inner end 72 of the first rod 68 enters the third joint above and on the opposite side from the inner end 80 of the second rod 76. The first and second rods have opposed, tapered ends.

The third joint 43 is cylindrical and has a central opening 74 extending through it. The third joint is divided into an upper section 43*a* and a lower section 43*b* which rotate relative to one another. The inner end 72 of the first rod 68 extends into the upper section 43*a* and the inner end 80 of the second rod 76 extends into the lower section 43*b*. Located in the third joint 43 is an upper wedge 82 and a lower wedge 84. The wedges 82 and 84 are cylindrical and are sized to slidably fit in the cylindrical opening 74. The upper surface of the upper wedge 82 is oriented normal to the center line of the cylindrical opening 74 and its lower surface 86 is tapered at an angle which is opposite the angle of the inner end of the first rod 68. Thus, the lower surface 86 of the upper wedge 82 overlies the inner end 72 of the first rod. The lower surface of the lower wedge 84 is normal to the center line of the cylindrical opening 74, and its upper surface 88 is tapered at an angle which is opposite to the angle of the inner end 80 of the second rod 76. Thus, the upper surface 88 overlies the inner end of the second rod 76. The wedges have aligned openings passing through them along the center line of the cylindrical opening 74, and a bolt 90 extends through the openings. The handle 54 has a threaded opening which engages the end of the bolt 90. Thus, tightening the handle 54 on the bolt 90 pulls the wedges inwardly toward one another. The wedges in turn push the arms 68 and 76 outwardly against the balls 62, locking the balls immovably in the first and second joints 46 and 50. As the wedges continue to be urged together, they also prevent rotation of the upper and lower third joint sections 43*a*, 43*b* relative to one another. Thus, tightening the handle 54 simultaneously locks up the first, second and third joints and holds the wheelchair in place on the platform 10.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An exercise apparatus for wheelchairs having large diameter driving wheels comprising:

(a) a platform having an upper surface which will support a wheelchair;

(b) front and rear rollers which are rotatably mounted on said platform and are configured to support said driving wheels and permit rotation of said driving wheels when said wheelchair is on said platform;

(c) one or more attachment arms which hold said wheelchair immovably on said platform, said attachment arm having a first arm section with a first joint located at an outer end thereof which is pivotally attached to said platform, a second arm section with a second joint located at an outer end thereof which is pivotally attached to a clamp device which can be removably attached to a frame element of said wheelchair, and an articulated center having a third joint which permits inner ends of said arm sections to rotate relative to one another; and (d) a clamp mechanism which permits fixing said first, second and third joints simultaneously upon activation of a single activation member.

2. The exercise apparatus of claim 1, including a rotating flywheel device which is connected to one of said front and rear rollers and which rotates when said one of said front and rear rollers is rotated to impart momentum to the rotating driving wheel of said wheelchair.

3. The exercise apparatus of claim 1 wherein said clamp mechanism has a rotatable handle which moves said clamp mechanism between clamped and unclamped positions.

4. The exercise apparatus of claim 1, including a ramp which allows a wheelchair to be driven up onto said platform.

5. The exercise apparatus of claim 1, further including:

(a) said first and second joints each including a ball which is carried in a socket;

(b) a first rod which is slidably carried in said first arm section and a second rod which is slidably carried in said second arm section;

(c) said first and second rods having outer ends which abut respective ones of said balls;

(d) said first and second rods having inner ends which terminate within said third joint and have opposed sloping extremities;

(e) said third joint includes an upper section which is attached to said first arm section and a lower section which is attached to said second arm section, said upper and lower sections being rotatable relative to one another; and (f) an upper wedge which fits within said upper section and engages the sloping extremity of said inner end of said first rod, and a second wedge which fits within said lower section and engages the sloping extremity of said inner end of said second rod, such that urging said upper and lower wedges toward one another prevents rotation of said upper and lower sections and pushes said first and second rods outwardly against respective ones of said balls to prevent rotations of said first and second joints.

6. The exercise device of claim 2 wherein said flywheel device includes:

(a) a blade having weights at both extremities thereof, said blade being rotatably mounted on said platform; and (b) an endless belt which extends between a pulley associated with said one of said front and rear rollers and a pulley associated with said blade.

* * * * *

UNITED STATES PATENT AND TRADEMARK OFFICE

CERTIFICATE OF CORRECTION

PATENT NO. : 6,645,127 B1
DATED : November 11, 2003
INVENTOR(S) : Pestes, Larry

It is certified that error appears in the above-identified patent and that said Letters Patent is hereby corrected as shown below:

Column 2,
Line 29, insert a space between “41a” and “and”“ in “41aand”

Signed and Sealed this

Twenty-sixth Day of April, 2005

JON W. DUDAS
*Director of the United States Patent and Trademark Office*